US007402976B2

(12) United States Patent
Lee et al.

(10) Patent No.: US 7,402,976 B2
(45) Date of Patent: Jul. 22, 2008

(54) APPARATUS AND METHOD FOR CONTROLLING OPERATION OF COMPRESSOR

(75) Inventors: Chel-Woong Lee, Seoul (KR); Chang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 427 days.

(21) Appl. No.: 11/108,670

(22) Filed: Apr. 19, 2005

(65) Prior Publication Data

US 2006/0153688 A1 Jul. 13, 2006

(30) Foreign Application Priority Data

Jan. 7, 2005 (KR) ..... 10-2005-0001754

(51) Int. Cl.
*H02P 1/42* (2006.01)

(52) U.S. Cl. ..... 318/785; 318/783; 318/778; 318/791

(58) Field of Classification Search ..... 318/778, 318/783, 785, 786, 791
See application file for complete search history.

(56) References Cited

U.S. PATENT DOCUMENTS 5,451,853 A * 9/1995 Itoh ..... 318/788
5,729,416 A * 3/1998 Renkes et al. ..... 361/23
6,040,679 A * 3/2000 Monk et al. ..... 318/778
6,239,523 B1 5/2001 Janicek et al.
6,249,104 B1 * 6/2001 Janicek ..... 318/791
6,407,530 B1 * 6/2002 Kwon et al. ..... 318/778
6,644,943 B1 11/2003 Lilie et al.

FOREIGN PATENT DOCUMENTS

| | | |
|---|---|---|
| JP | 64-029682 | 1/1989 |
| KR | 20040036963 | 5/2004 |
| WO | 2004/057739 | 7/2004 |

OTHER PUBLICATIONS

U.S. Appl. No. 10/896,278 to Eon Pyo Hong et al., filed Jul. 22, 2004.

* cited by examiner

*Primary Examiner*—Rina I Duda
(74) *Attorney, Agent, or Firm*—Greenblum & Bernstein, P.L.C.

(57) ABSTRACT

An apparatus for controlling an operation of a compressor includes a controller for generating a control signal for selecting an operation mode of a compressor according to an operation load of the compressor; a first switching unit connected to a motor consisting of a main coil and a sub-coil and selecting the main coil or both the main coil and the sub-coil according to the control signal; first and second capacitors electrically connected with the first switching unit; and a second switching unit connected to the first capacitor and selectively connecting the first capacitor in parallel to the second capacitor according to the control signal.

14 Claims, 2 Drawing Sheets

APPARATUS AND METHOD FOR CONTROLLING OPERATION OF COMPRESSOR

BACKGROUND OF THE INVENTION

1. Field of the Invention

The present invention relates to a compressor and, more particularly, to an apparatus and method for controlling an operation of a reciprocating compressor.

2. Description of the Conventional Art

In general, without a crank shaft for converting a rotational motion to a linear motion, a reciprocating compressor has a little friction loss, and thus, it has higher compression efficiency than general compressors.

When the reciprocating compressor is used for a refrigerator or an air-conditioner, a compression ratio of the reciprocating compressor can be varied to control cooling capacity by varying a stroke voltage applied to the reciprocating compressor.

The conventional reciprocating compressor will now be described with reference to FIG. 1.

FIG. 1 is a block diagram showing the construction of an apparatus for controlling an operation of a reciprocating compressor in accordance with a conventional art.

As shown in FIG. 1, the apparatus for controlling an operation of the reciprocating compressor includes: a voltage detector 14 for detecting a voltage applied to a reciprocating compressor 13 as a stroke of the reciprocating compressor 13 is varied; a current detector 12 for detecting a current applied to the reciprocating compressor 13 as the stroke is varied; a microcomputer 15 for calculating a stroke based on the voltage value detected by the voltage detector 14 and the current value detected by the current detector 12, comparing the calculated stroke with a stroke reference value, and generating a switching control signal according to the comparison result; and a power supply unit 11 for supplying a stroke voltage to the reciprocating compressor 13 by controlling ON/OFF of AC power supplied to the reciprocating compressor 13 with an internal triac Tr1 according to the switching control signal generated by the microcomputer 15. Herein, the reciprocating compressor 13 varies the stroke upon receiving the stroke voltage provided to an internal motor (not shown) according to the stroke reference value previously set by a user, and reciprocally moves an internal piston (not shown).

The apparatus for controlling an operation of the reciprocating compressor in accordance with the conventional art operates as follows.

First, when a voltage is supplied to the internal motor according to the stroke reference value as set by the user, the reciprocating compressor 13 varies the stroke and reciprocally moves the piston. Herein, the stroke means a distance along which the piston of the reciprocating compressor 13 is reciprocally moved.

The turn-on duration of the triac (Tr1) of the power supply unit 11 is lengthened by the switching control signal outputted from the microcomputer 15, and accordingly, the AC power is supplied to the reciprocating compressor 13 to drive the reciprocating compressor 13. At this time, the voltage detector 14 and the current detector 12 detect the voltage and the current applied to the reciprocating compressor 13, respectively, and output the detected voltage and current values to the microcomputer 15.

The microcomputer 15 calculates the stroke of the reciprocating compressor 13 based on the voltage and current values respectively detected by the voltage detector 14 and the current detector 12, compares the calculated stroke value with the stroke reference value, and generates a switching control signal according to the comparison result. For example, if the calculated stroke value is smaller than the stroke reference value, the microcomputer 15 outputs a switching control signal for lengthening the turn-on duration of the triac (Tr1) to the power supply unit 11 to increase the stroke voltage supplied to the reciprocating compressor 13.

If, however, the calculated stroke value is greater than the stroke reference value, the microcomputer 15 outputs a switching control signal for shortening the turn-on duration of the triac Tr1 to the power supply unit 11 to reduce the stroke voltage supplied to the reciprocating compressor 13.

The single capacitor 16 connected in series to the internal motor of the reciprocating compressor 13 countervails an inductance of a coil wound in the internal motor.

Meanwhile, in the conventional apparatus for controlling an operation of the reciprocating compressor, when the voltage is applied to the motor of the compressor 13 through the triac Tr1 in order to control the stroke of the compressor, a noise is generated. In order to cancel the noise, a relay 17 and a motor 18 consisting of a main coil 19 and a sub-coil 20 as shown in FIG. 2 are required.

For example, the relay selects only the main coil 19 or both the main coil 19 and the sub-coil 20 according to a change in the voltage inputted to the compressor and a change in an operation load of the compressor, to thereby vary capacity of the motor 18. For example, if an inputted voltage is increased or an operation load of the compressor is greater than a pre-set reference load (namely, in case of an overload), the microcomputer 15 controls the relay 17 to select only the main coil 19 to reduce a back electromotive force constant of the motor 18.

Meanwhile, if the voltage inputted to the compressor is reduced or the operation load of the compressor is smaller than the pre-set reference load (namely, underload), the microcomputer 15 controls the relay 17 to select both the main coil 19 and the sub-coil 20 to increase the back electromotive force constant of the motor 18. Herein, the operation mode of the compressor is changed to a power mode or a safe mode according to the change in the voltage inputted to the compressor and the change in the operation load of the compressor. The power mode refers to a method in which the motor is operated through only the main coil while the safe mode refers to a mode in which the motor is operated through both the main coil and the sub-coil.

The number (N) of times of winding of the coil wound at the motor 18 of the reciprocating compressor is proportional to the back electromotive force constant of the motor, so when a certain voltage is applied to the compressor, the stroke of the compressor and the number of times of winding of the coil are in inverse proportion as expressed in equation (1) shown below:

$$\text{Stroke} \cong \frac{\text{Voltage}}{MotorConstant} \propto \frac{\text{Voltage}}{N} \tag{1}$$

Accordingly, the motor can be controlled by varying its capacity by controlling the relay 17 according to the change in power applied to the compressor and the change in the operation load of the compressor.

However, as for the apparatus for controlling the operation of the reciprocating compressor in accordance with the conventional art, when the compressor is in the power mode or in the safe mode, power is applied to the motor 18 of the compressor through only one capacitor connected to the motor 18, causing a problem that the operation of the compressor is unstable. For example, when the operation mode of the compressor is changed from the safe mode to the power mode or from the safe mode to the power mode, the number of times of winding of the coil of the motor is changed and thus the inductance of the motor coil is changed. But since the compressor is operated through only one capacitor, the compressor is operated unstably.

U.S. Pat. No. 6,644,943 issued on Nov. 11, 2003 also discloses a reciprocating compressor.

SUMMARY OF THE INVENTION

Therefore, one object of the present invention is to provide an apparatus and method for controlling an operation of a compressor capable of operating a compressor stably by varying capacitance of a capacitor electrically connected with a motor of the compressor when a value of inductance of a motor coil is varied according to an operation load of the compressor.

Another object of the present invention is to provide an apparatus and method for controlling an operation of a compressor capable of reducing power consumption by preventing unnecessary waste of a current when an operation mode of a compressor is changed.

Still another object of the present invention is to provide an apparatus and method for controlling an operation of a compressor capable of preventing an overcurrent when an operation mode of a compressor is changed and quickly changing the operation mode of the compressor.

To achieve these and other advantages and in accordance with the purpose of the present invention, as embodied and broadly described herein, there is provided an apparatus for controlling an operation of a compressor including: a controller for generating a control signal for selecting an operation mode of a compressor according to an operation load of the compressor; a first switching unit connected to a motor consisting of a main coil and a sub-coil and selecting the main coil or both the main coil and the sub-coil according to the control signal; first and second capacitors electrically connected with the first switching unit; and a second switching unit connected to the first capacitor and selectively connecting the first capacitor in parallel to the second capacitor according to the control signal.

To achieve the above objects, there is also provided an apparatus for controlling an operation of a compressor including: a controller for generating a control signal for selecting an operation mode of a compressor according to an operation load of the compressor; a first switching unit connected to a motor consisting of a main coil and a sub-coil and selecting the main coil or both the main coil and the sub-coil according to the control signal; first and second capacitors electrically connected with the first switching unit; a second switching unit connected to the first capacitor and selectively connecting the first capacitor in parallel to the second capacitor according to the control signal; a third switching unit connected in parallel with the first switching unit; and a PTC (Positive Temperature Coefficient) thermistor connected in series with the third switching unit, wherein the third switching unit controls the PTC thermistor according to the control signal.

To achieve the above objects, there is also provided an apparatus for controlling an operation of a compressor including: a voltage detector for detecting a voltage applied to a reciprocating compressor as a stroke of the reciprocating compressor is varied; a current detector for detecting a current applied to the reciprocating compressor as the stroke is varied; a microcomputer for calculating a stroke based on the voltage value detected by the voltage detector and the current value detected by the current detector, comparing the calculated stroke with a stroke reference value, generating a switching control signal according to the comparison result, and generating a mode control signal for selecting an operation mode of the reciprocating compressor according to an operation load of the reciprocating compressor; a power supply unit for supplying a stroke voltage to the reciprocating compressor by controlling ON/OFF of AC power applied to the reciprocating compressor with an internal triac according to the switching control signal generated by the microcomputer; a first switching unit connected to a motor consisting of a main coil and a sub-coil and selecting the main coil or selecting both the main coil and the sub-coil according to the control signal; first and second capacitors electrically connected with the first switching unit; a second switching unit connected to the first capacitor and selectively connecting the first capacitor in parallel to the second capacitor according to the mode control signal; a third switching unit connected in parallel with the first switching unit; and a PTC thermistor connected in series with the third switching unit, wherein the third switching unit controls the PTC thermistor according to the control signal.

To achieve the above objects, there is also provided an apparatus for controlling an operation of a compressor including: a controller for outputting a control signal for changing an operation mode of a compressor; a PTC thermistor connected with a motor of the compressor and cutting off an overcurrent applied to the motor when the operation mode of the compressor is changed; and a switching unit connected to the PTC thermistor, and applying a current to the PTC thermistor or cutting off a current applied to the PTC thermistor according to the control signal, wherein when the operation mode of the compressor is changed, the controller turns on the switching unit, and then, when a predetermined time elapses, the controller turns off the switching unit.

To achieve the above objects, there is also provided a method for controlling an operation of a compressor including: applying a current to a PTC thermistor electrically connected with a motor of a compressor when an operation mode of the compressor is changed; and cutting off a current applied to the PTC thermistor through a switching unit connected to the PTC thermistor when a predetermined time elapses.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An apparatus for controlling an operation of a compressor capable of operating a compressor stably, preventing unnecessary waste of a current when an operation mode of the compressor is changed, and quickly changing the operation mode, in accordance with a preferred embodiment of the present invention will now be described with reference to FIGS. 3 and 4.

A voltage detector 14, a current detector 12, a microcomputer 15 and a power supply unit 11 of the present invention are the same as those in the conventional art, descriptions of which are thus omitted.

Figure 1:
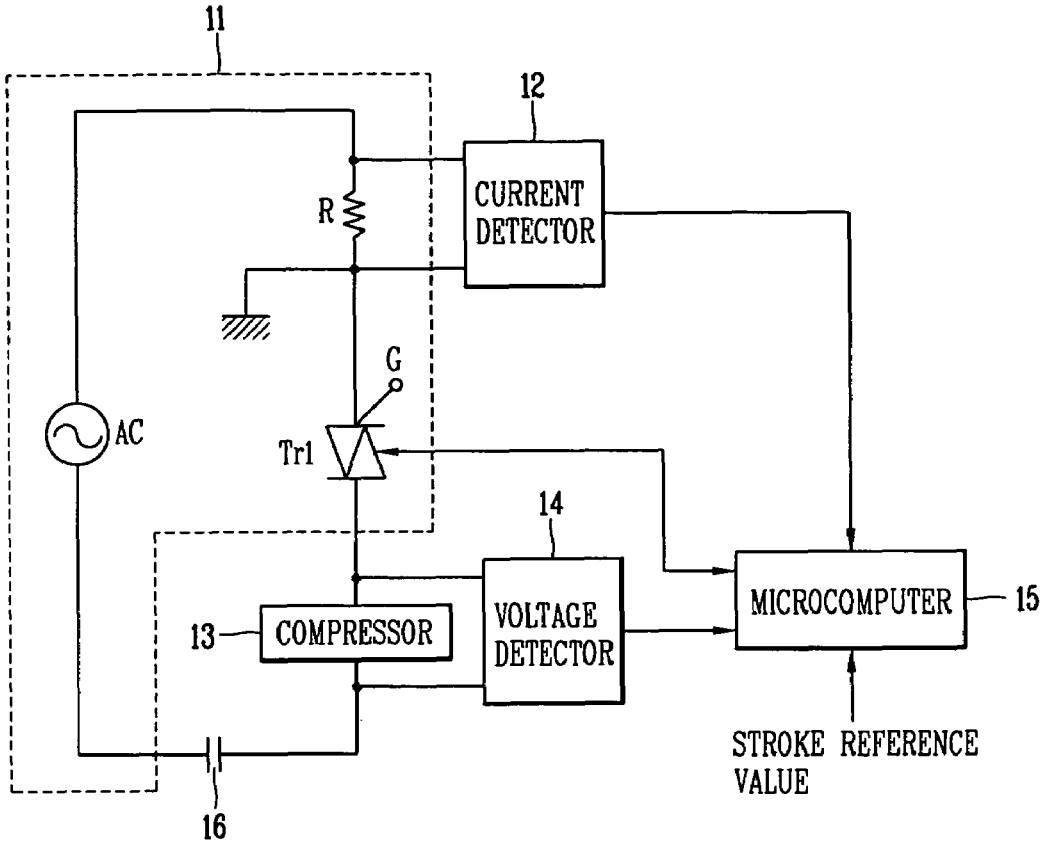
FIG. 1 CONVENTIONAL ART
FIG. 1 is a block diagram showing the construction of an apparatus for controlling a compressor in accordance with a conventional art.
Figure 2:
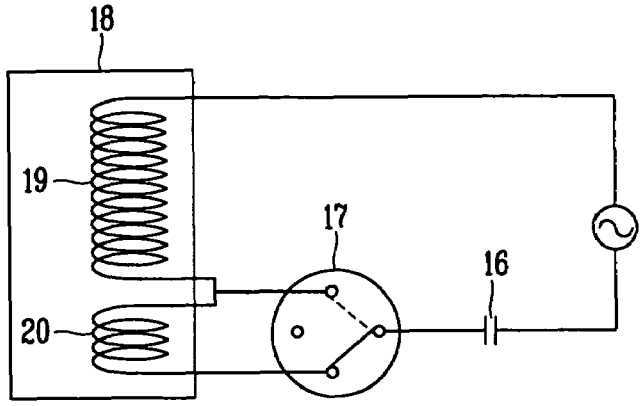
FIG. 2 CONVENTIONAL ART
FIG. 2 is a block diagram showing the construction of the apparatus for controlling an operation of the compressor having a motor consisting of a main coil and a sub-coil in accordance with the conventional art.
Figure 3:
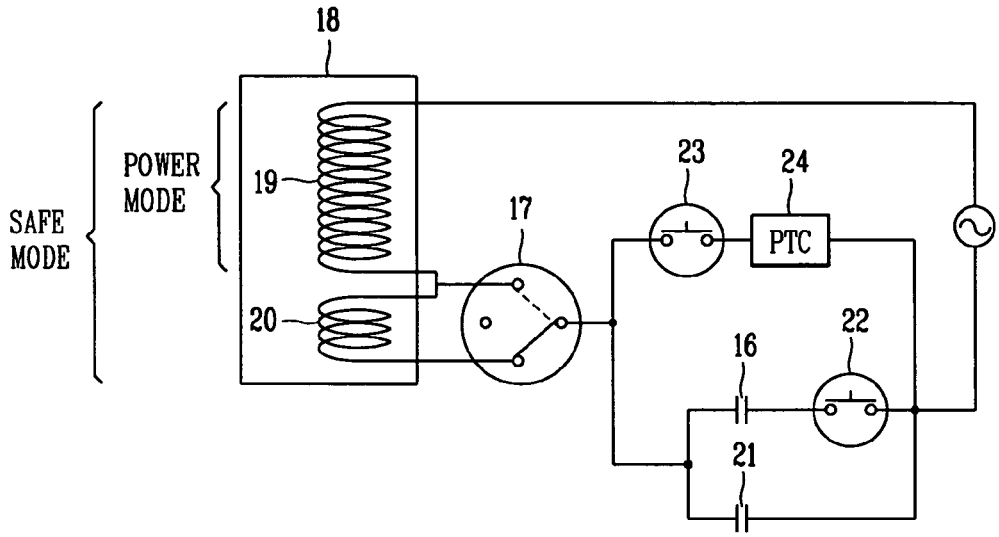
FIG. 3 is a block diagram showing the construction of an apparatus for controlling an operation of a compressor in accordance with the present invention.
Figure 4:
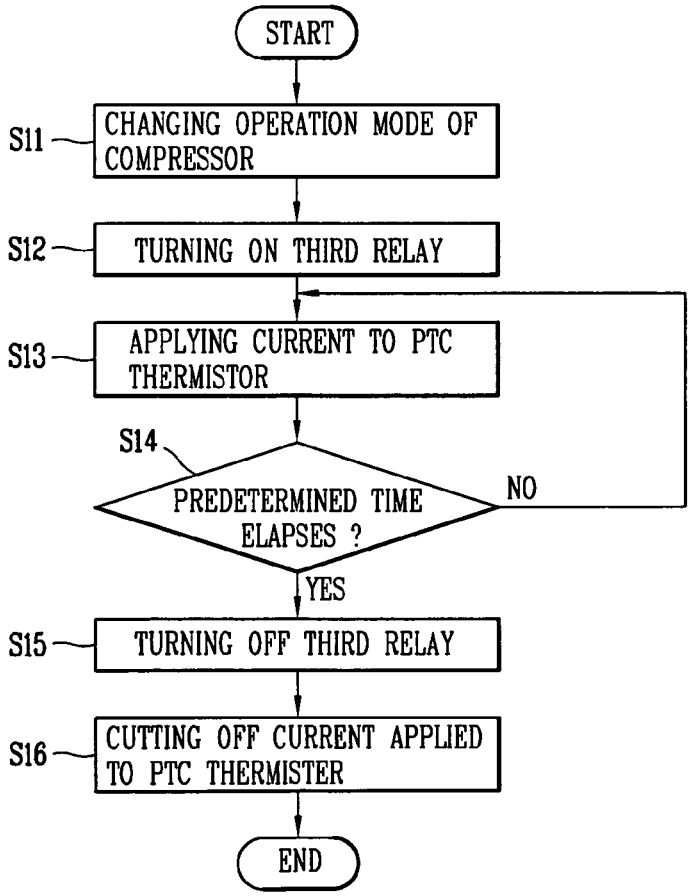
FIG. 4 is a flow chart of a method for controlling an operation of the compressor in accordance with the present invention.

FIG. 3 is a block diagram showing the construction of an apparatus for controlling an operation of a compressor in accordance with the present invention.

As shown in FIG. 3, an apparatus for controlling an operation of a compressor in accordance with the present invention includes: a controller (not shown) for generating a control signal for selecting an operation mode of the compressor according to an operation load of the compressor; a first relay 17 electrically connected to a motor 18 consisting of a main coil 19 and a sub-coil 20, and selecting only the main coil 19 or selecting both the main coil 19 and the sub-coil 20 according to the control signal for selecting the operation mode of the compressor; first and second capacitors 16 and 21 connected in parallel to the relay 17; and a second relay 22 connected to the first capacitor 16 and applying power to the first capacitor 16 or cutting off power applied to the first capacitor 16 based on the control signal for selecting the operation mode of the compressor.

The controller changes an operation mode of the compressor to a power mode or a safe mode according to a change of a voltage applied to the compressor or a change of an operation load of the compressor.

For example, when a voltage applied to the compressor is increased or when an operation load of the compressor is greater than a pre-set reference load, the controller outputs a control signal for changing the operation mode of the compressor to the power mode to the first and second relays 17 and 22.

Meanwhile, when the voltage applied to the compressor is reduced or when the operation load of the compressor is smaller than the pre-set reference load, the controller outputs a control signal for changing the operation mode of the compressor to the safe mode to the first and second relays 17 and 22.

The power mode is a mode for operating the motor 18 installed in the compressor through only the main coil 19, and the safe mode is a mode for operating the motor 18 through both the main coil 19 and the sub-coil 20.

The number of windings of the main coil 19 and that of the sub-coil 20 can be different or the same. Preferably, capacitance of the first and second capacitors 16 and 21 is determined based on an inductance value of the motor coil.

The apparatus for controlling the operation of the compressor in accordance with the present invention further includes: a third relay 23 connected in parallel to the first relay 17 and turned on/off according to a control signal of the controller; and a PTC thermistor 24 connected in series to the third relay 23 and cutting off an overcurrent generated when the compressor is initially started or when the operation mode of the compressor is changed, in order to prevent damage of the reciprocating compressor.

The third relay 23 applies a current to the PTC thermistor 24 or cuts off the current applied to the PTC thermistor 24 according to a control signal of the controller. At this time, in order to cut off an overcurrent or quickly change the operation mode of the compressor, the controller turns on the third relay 23 when the operation mode of the compressor is changed, and then, when a predetermined time elapses (e.g., 2 seconds), the controller turns off the third relay 23.

Thus, by additionally installing the PTC thermistor 24 in the apparatus for controlling the operation of the reciprocating compressor, the overcurrent generated when the reciprocating compressor is initially driven or when the operation mode of the reciprocating compressor is changed can be cut off.

In addition, by connecting the third relay 23 in series to the PTC thermistor 24, the operation mode of the compressor can be quickly changed. For example, usually, when a self resistance value of the PTC thermistor 24 increases, the PTC thermistor 24 wouldn't be turned off until about one minute elapses. Thus, in the present invention, rather than waiting for the time (one minute) taken for turning off the PTC thermistor 24 by itself, the PTC thermistor 24 is quickly turned off through the third relay 23. Accordingly, the current unnecessarily flowing at the PTC thermistor 24 during one minute can be cut off, and thus, current consumption can be prevented and the operation mode of the compressor can be promptly changed.

The operation of the apparatus for controlling the operation of the compressor in accordance with the present invention will now be described in detail.

First, the controller operates the compressor according to an operation load of the compressor. For example, if it is assumed that the compressor is installed in an air-conditioner, the compressor would be operated based on a desired temperature previously set by a user and a room temperature. In this case, an operation mode of the compressor is changed to a power mode or a safe mode based on the pre-set desired temperature and the room temperature. Namely, when a voltage inputted to the compressor is increased, or when an operation load of the compressor is greater than a pre-set reference load, the operation mode of the compressor is preferably changed to the power mode.

And, when the operation mode of the compressor needs to be changed to the power mode according to the operation load of the compressor, namely, when the operation load of the compressor is greater than the reference load, the controller generates a first control signal for changing the operation mode of the compressor to the power mode and outputs the first control signal to the first and second relays 17 and 22. In this case, various switching units can be used instead of the relay.

The operation of the apparatus for controlling the operation of the compressor when the operation mode of the compressor is changed to the power mode will now be described.

First, the first relay 17 selects only the main coil 19 according to the first control signal outputted from the controller. Then, because power flows only at the main coil 19, a back electromotive force constant of the motor is reduced.

The second relay 22 applies power to the first capacitor 16 according to the first control signal of the controller so that power can be applied to the main coil 19 through the first and second capacitors 16 and 21. Namely, when only the main coil 19 is selected, the controller connects the first and second capacitors 16 and 21 in order to increase capacitance and perform an LC resonation operation.

Meanwhile, when the operation mode of the compressor needs to be changed to the safe mode according to an operation load of the compressor, if the operation load of the compressor is smaller than the reference load, the controller generates a second control signal for changing the operation mode of the compressor to the safe mode and outputs it to the first and second relays 17 and 22.

The operation of the apparatus for controlling the operation of the compressor when the operation mode of the compressor is changed to the safe mode will be described as follows.

First, the first relay 17 selects the main coil 19 and the sub-coil 20 according to a second control signal outputted from the controller. Then, because power flows through the main coil 19 and the sub-coil 20, the back electromotive force constant of the motor is increased.

The second relay 22 opens the first capacitor 16 according to the second control signal of the controller to cut off power applied to the first capacitor 16, so that power can be applied to the main coil 19 and the sub-coil 20 through only the second capacitor 21. Namely, when the main coil 19 and the sub-coil 20 are selected, the controller cuts off power applied to the first capacitor 16 in order to reduce capacitance and perform the LC resonation operation.

Thus, by varying the capacitance value of resonating capacitors connected to the motor when the value of the inductance of the motor coil according to the operation load of the compressor, the compressor can be stably driven.

Meanwhile, the operation of the PTC thermistor 24 and the relay 23 additionally formed in the apparatus for controlling the operation of the compressor in accordance with the present invention will be described in detail with reference to FIG. 4 as follows.

First, in order to cut off an overcurrent, when the reciprocating compressor is initially started or when the operation mode of the reciprocating compressor is changed, the controller turns on the third relay 23 (steps S11 and S12). Then, a current flows at the PTC thermistor 24 (step S13).

In other words, when the reciprocating compressor is initially started or when the operation mode of the reciprocating compressor is changed, the controller turns on the third relay 23 to cut off the overcurrent and changes the operation mode of the compressor to the power mode or the safe mode according to a change of a voltage and a change of a load.

When the compressor initially started or when the operation mode of the compressor is changed, the PTC thermistor 24 cuts off the overcurrent applied to the motor 18 of the compressor to protect the compressor against the overload.

In addition, when a resistance value of the PTC thermistor 24 is increased due to the current applied to the internal motor (M) of the reciprocating compressor 13, the PTC thermistor 24 is turned off and the current is applied to the motor 18 through only the first capacitor 16 or the first and second capacitors 16 and 21.

If the PTC thermistor 24 would not be turned off even when the operation mode of the compressor is changed to the power mode or the safe mode, the compressor would not operate in the power mode or in the safe mode. Namely, the compressor does not operate in the power mode or in the safe mode until the PTC thermistor 24 itself is turned off. Time required for the PTC thermistor 24 itself to be turned off is about 1 minute.

Accordingly, when the operation mode of the compressor is changed to the power mode or the safe mode, the controller turns on the third relay 23, and then, when a predetermined time (e.g., 2 seconds) elapses (step S14), the controller turns off the PTC thermistor 24. That is, rather than waiting until the PTC thermistor 24 itself is turned off, the third relay is turned off when the predetermined time elapses, so that a current that may flow to the PTC thermistor 22 can be cut off, and thus, power consumption can be reduced and the compressor can be quickly operated in the power mode or in the safe mode (step S15).

As so far described, the apparatus for controlling the operation of the compressor in accordance with the present invention has many advantages.

That is, for example, first, when the inductance value of the motor coil installed at the compressor is changed, the capacitance value of the capacitors connected to the motor is varied to thereby stably drive the compressor.

Second, when the operation mode of the compressor is changed, unnecessary current consumption can be prevented, and thus, power consumption can be reduced.

Third, when the operation mode of the compressor is changed, an overcurrent is prevented and the operation mode of the compressor can be quickly changed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a compressor, comprising:

a controller which generates a control signal to select an operation mode of the compressor according to an operation load of the compressor;

a first switch connected to a motor, the motor comprising a main coil and a sub-coil, wherein the main coil or both the main coil and the sub-coil is selected according to the control signal;

first and second capacitors electrically connected with the first switch;

a second switch connected to the first capacitor and selectively connecting the first capacitor in parallel to the second capacitor according to the control signal;

a third switch connected in parallel with the first switch; and a PTC (Positive Temperature Coefficient) thermistor connected in series with the third switch, wherein the third switch controls the PTC thermistor according to the control signal.

2. The apparatus of claim 1, wherein the controller turns off the third switch when a predetermined time elapses.

3. The apparatus of claim 1, wherein when the operation mode of the controller is changed or when the compressor is initially driven, the controller turns on the third switch, and then, when a predetermined time elapses, the controller turns off the third switch.

4. The apparatus of claim 1, wherein when the operation load of the compressor is greater than a reference load, the controller generates a first control signal to select the main coil.

5. The apparatus of claim 4, wherein when the operation load of the compressor is smaller than the reference load, the controller generates a second control signal to select the main coil and the sub-coil.

6. The apparatus of claim 1, wherein when the main coil is selected by the first switch, the second switch connects the first capacitor in parallel to the second capacitor.

7. The apparatus of claim 1, wherein when the main coil and the sub-coil are selected by the first switch, the second switch cuts off power applied to the first capacitor.

8. The apparatus of claim 1, wherein when the main coil is selected by the first switch, the first and second capacitors are connected in parallel to each other by the second switch.

9. The apparatus of claim 1, wherein when the main coil and the sub-coil are selected by the first switch, one of the first and second capacitors is opened by the second switch.

10. An apparatus for controlling an operation of a compressor, comprising:

a voltage detector which detects a voltage applied to a reciprocating compressor as a stroke of the reciprocating compressor is varied;

a current detector which detects a current applied to the reciprocating compressor as the stroke is varied;

a microcomputer which calculates a stroke based on the voltage value detected by the voltage detector and the current value detected by the current detector, compares the calculated stroke with a stroke reference value, generates a switching control signal according to the comparison result, and generates a mode control signal to select an operation mode of the reciprocating compressor according to an operation load of the reciprocating compressor;

a power supply which supplies a stroke voltage to the reciprocating compressor by controlling ON/OFF of AC power applied to the reciprocating compressor with an internal triac according to the switching control signal generated by the microcomputer;

a first switch connected to a motor, the motor comprising a main coil and a sub-coil, wherein the main coil or both the main coil and the sub-coil is selected according to the control signal, wherein the motor is provided within the reciprocating compressor;

first and second capacitors electrically connected with the first switch;

a second switch connected to the first capacitor and selectively connecting the first capacitor in parallel to the second capacitor according to the mode control signal;

a third switch connected in parallel with the first switch; and a PTC (Positive Temperature Coefficient) thermistor connected in series with the third switch, wherein the third switch controls the PTC thermistor according to the control signal.

11. An apparatus for controlling an operation of a compressor, comprising:

a controller which outputs a control signal to change an operation mode of the compressor;

a PTC (Positive Temperature Coefficient) thermistor connected with a motor of the compressor and cutting off an overcurrent applied to the motor when the operation mode of the compressor is changed; and a switch connected to the PTC thermistor, and applying a current to the PTC thermistor or cutting off a current applied to the PTC thermistor according to the control signal; and at least one capacitor connected in parallel with the PTC thermistor and the switch, wherein when the operation mode of the compressor is changed, the controller turns on the switch, and then, when a predetermined time elapses, the controller turns off the switch.

12. A method for controlling an operation of a compressor comprising:

applying a current to a PTC (Positive Temperature Coefficient) thermistor electrically connected with a motor of the compressor when an operation mode of the compressor is changed; and cutting off a current applied to the PTC thermistor through a switch connected to the PTC thermistor and applying a current to the motor through one or more capacitors when a predetermined time elapses.

13. The method of claim 12, wherein in applying the current to the PTC thermistor, the current is applied to the PTC thermistor in order to cut off an overcurrent generated when the operation mode of the compressor is changed.

14. The method of claim 12, wherein in cutting off the current applied to the PTC thermistor, the current applied to the PTC thermistor is cut off when the predetermined time elapses so as to change the operation mode of the compressor.

* * * * *